US005283993A

United States Patent [19]

Sprung, Sr.

[11] Patent Number: 5,283,993

[45] Date of Patent: Feb. 8, 1994

[54] HYDRAULICALLY-OPERATED SCISSOR OPENING FOR STRESSED MEMBRANE STRUCTURE

[76] Inventor: Philip D. Sprung, Sr., 12219 Lake Louise Way SE., Calgary, Alberta, Canada, T2J 2N2

[21] Appl. No.: 709,713

[22] Filed: Jun. 3, 1991

[51] Int. Cl.[5] ..... E04B 1/346

[52] U.S. Cl. ..... 52/64; 135/102; 135/109; 135/117; 160/58.1; 49/324

[58] Field of Search ..... 135/102, 109, 103, 117; 160/58.1; 52/64, 69, 109; 49/324

[56] References Cited

U.S. PATENT DOCUMENTS

| | | | |
|---|---|---|---|
| 1,257,535 | 2/1918 | Sampson | 160/58.1 X |
| 2,806,477 | 9/1957 | Fritsche | 135/102 |
| 3,161,231 | 12/1964 | Dawson et al. | 135/102 X |
| 3,820,553 | 6/1974 | Huddle | 135/102 X |
| 4,886,083 | 12/1989 | Gamache | 135/109 X |
| 5,121,765 | 6/1992 | MacMorris, Jr. | 135/110 X |

FOREIGN PATENT DOCUMENTS

| | | | |
|---|---|---|---|
| 0407029 | 3/1934 | United Kingdom | 160/58.1 |

*Primary Examiner*—Carl D. Friedman
*Assistant Examiner*—Lan M. Mai
*Attorney, Agent, or Firm*—Francis C. Hand

[57] ABSTRACT

A door system for a stressed fabric structure comprising a stationary arched anchor beam, the ends of which are supported on the base at one end of the structure, a plurality of movable arched beams of similar size and shape on the side of the anchor beam away from the structure and having supporting ends pivotally secured at the ends of the anchor beam, the movable beams to pivot along the same radial path about common pivot points at the ends, between raised, open position adjacent to the anchor beam and closed position in which the beams are spaced progressively from the anchor beam to the structure base. Fabric panels are secured to and extend between each of the anchor beam and its adjacent movable beam and adjacent pairs of movable beams so as to be under similar tension when the beams are in closed position. Hydraulic pistons or other mechanical arrangements are provided simultaneously to move the movable beams to open or closed positions and maintain them as required in said open or closed positions or positions intermediate thereto.

19 Claims, 4 Drawing Sheets

HYDRAULICALLY-OPERATED SCISSOR OPENING FOR STRESSED MEMBRANE STRUCTURE

FIELD OF THE INVENTION

The present invention relates to a door system for a stressed fabric structure.

BACKGROUND OF THE INVENTION

Stressed fabric structures conventionally have walls and a roof formed of fabric secured to and extending under tension between spaced arched beams supported on a base. Such structures are extremely easy to assemble and disassemble, and hence are highly portable. Because the fabric is maintained in a stressed state when the structure is erected, such structures can readily withstand high winds and other forms of external loading such as snow and rain. Thus, they have become very popular for many applications, including temporary or permanent warehouses, enclosures for athletic facilities such as hockey rinks, temporary exhibition halls, military storage areas, hangars, etcetera. Such structures are described and illustrated for example in my earlier U.S. patents namely; U.S. Pat. No. 4,118,904 issued Oct. 10, 1978, entitled "Building Structure", U.S. Pat. No. 4,137,687 issued Feb. 6, 1978, entitled "Stressed Membrane Space Enclosure", and U.S. Pat. No. 3,780,477 issued Dec. 25, 1973, entitled "Demountable Building".

One of the technical problems presented by such structures is providing a suitable doorway for entrance to or exit from the structure. Because the walls are formed from fabric stretched between arched beams, a conventional frame may be provided between adjacent pairs of arched beams to support a vertically hinged door.

Where the structure is used, for example, as a hangar or warehouse, a larger doorway may be required. To accomplish this, in the past, a series of arched beams have been provided at the end of the structure, these arched beams being pivotably movable in sequence as a power cable connected to a last of the arched beams was retracted towards the building, to open the entire end of the structure (like a portion of a "clam shell"). A problem with this construction has been that when raising or lowering the door, the cable may break and the arches collapse, damaging or destroying anything underneath them. In addition, it is extremely difficult to raise or lower such a door in heavy wind storms using a cable, since the door can fly completely open as soon as the tie-down bars, securing the lowermost arch in position, are released. As a result, the size of the arched beams and their retracting mechanisms, as well as the concrete footings used to hold them in position, must be of significant size and weight.

It is an object therefore of the present invention to provide an alternative construction of door system for stressed fabric structures that avoids many of the problems of such prior known systems and that can be safely raised or lowered in a variety of conditions.

SUMMARY OF THE INVENTION

In accordance with the present invention there is provided a door system for a stressed fabric structure. The system comprises a stationary arched anchor beam, the ends of which are supported on a base at one end of the structure. A plurality of movable arched beams of similar size and shape located on the side of the anchor beam away from the structure have supporting ends that are pivotally secured at the ends of the anchor beam. The movable beams pivot along the same radial path about common pivot points at the ends, between a raised, open position adjacent to the anchor beam and a closed position in which the beams are spaced progressively from the anchor beam to the structure's base. Fabric panels are secured to and extend between the anchor beam and its adjacent movable beam and adjacent pairs of movable beams so as to be under similar tension when the beams are in closed position. Mechanical means are provided to simultaneously move the movable beams to open and closed positions and maintain them as required in said open or closed positions or positions intermediate thereto.

In a preferred embodiment, the means to move the beams comprises a plurality of linking beams, the ends of which are pivotally secured at pivot points to and extend between all adjacent beams of the door system. Cooperating pairs of adjacent linking beams extend from similar locations on alternate movable beams, in spreading, scissors-like fashion, to beams adjacent thereto on each side, to move their corresponding beams between open and closed positions. Drive means are associated with the linking beams to move them between said open and closed positions and maintain them as required in said open or closed positions or positions intermediate thereto. Corresponding ends of linking beams in each pair are secured at spaced locations to each of said alternative movable beams, and opposite spreading ends of the linking beams in each pair are secured to beams adjacent thereto on each side. As well, the pivot points, at which the ends of a cooperating pairs of linking beams are secured to the alternate movable beams, are slidable along the longitudinal axis of the corresponding arched beam. The pivot points at which the spreading ends of the pairs of linking beams are secured to beams adjacent the alternate movable beams are fixed to the corresponding beams and not relatively movable with respect thereto.

The door system according to the present invention permits the raising or lowering of the door without danger of collapse as was the case with previous cable systems which had been developed for this type of structure. As well, even in heavy winds, the door according to the present invention may be raised and lowered in safety. Since the door system according to the present invention closes and opens each section between the movable arched beams at the same time, it does not put undue forces on the bottom beam, as was caused with the previously used cable system. This permits a substantial reduction in the size of the beams, hinges and concrete footings used.

BRIEF DESCRIPTION OF THE DRAWINGS

These and other objects and advantages of the invention will become apparent upon reading the following detailed description and upon referring to the drawings in which.

Figure 1:
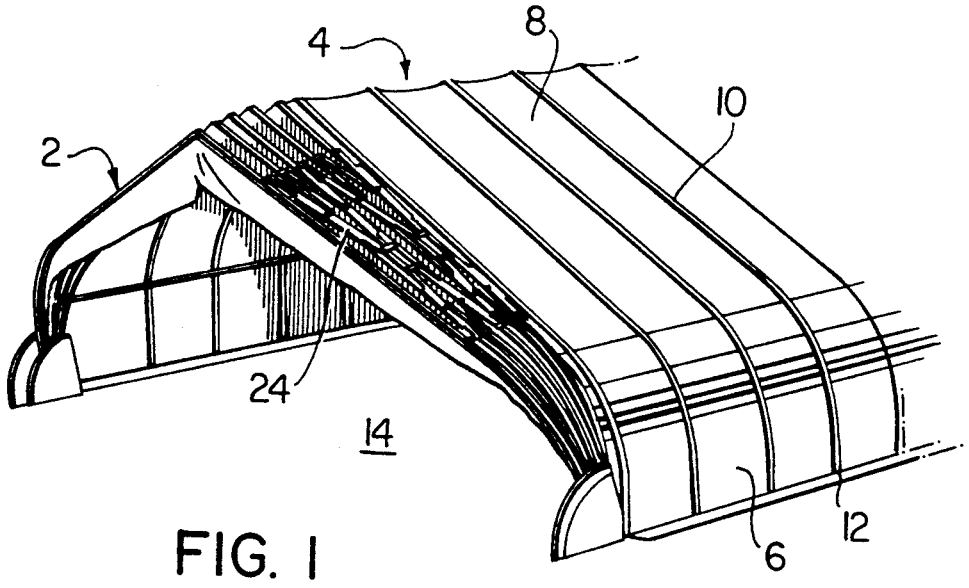
FIG. 1 is a perspective view of a portion of a stressed fabric structure having at one end a door system according to the present invention, the door being shown in nearly fully open position.

While the invention will be described in conjunction with an example embodiment, it will be understood that it is not intended to limit the invention to such embodiment. On the contrary, it is intended to cover all alternatives, modifications and equivalents as may be included within the spirit and scope of the invention as defined by the appended claims.

DETAILED DESCRIPTION OF THE INVENTION

In the drawings, similar features have been given similar reference numerals.

Figure 2:
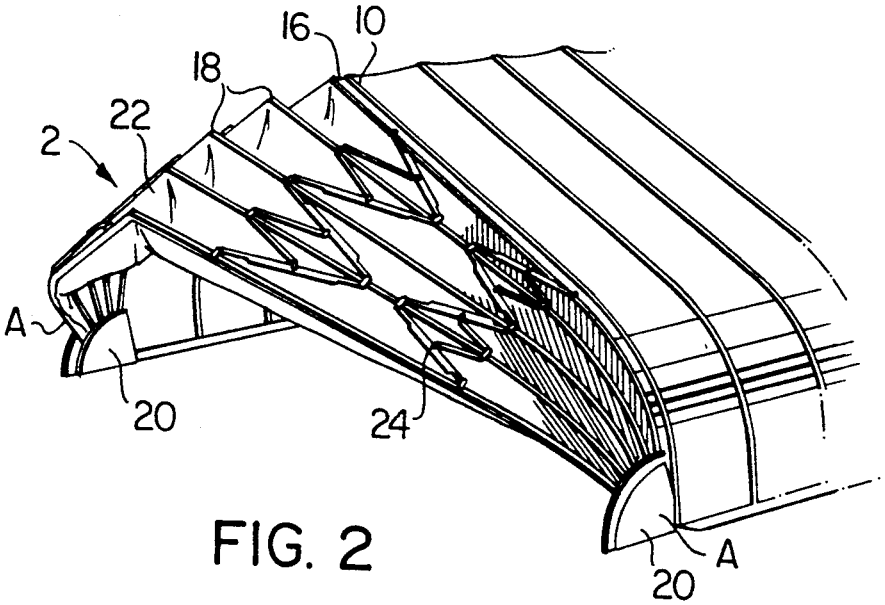
FIG. 2 is a similar view of the structure of FIG. 1 with the door in half closed position.
Figure 3:
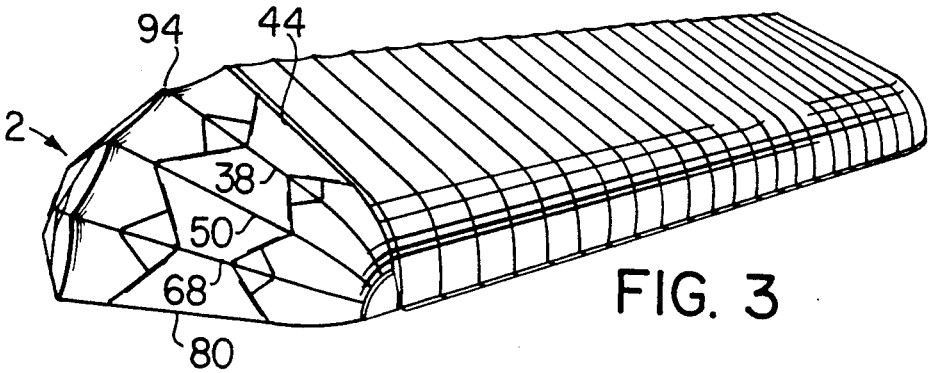
FIG. 3 is a schematic perspective view of the entire structure of FIG. 1 with the door in fully closed position.

Turning to FIGS. 1, 2 and 3 there is illustrated, respectively in almost fully open, half closed and fully closed positions, a door system 2 in accordance with the present invention, which door system has been mounted on an end of a stressed fabric structure 4, in accordance with the present invention. Stressed membrane fabric structure 4 has walls 6, and roof 8 made of fabric panels secured to and extending under tension between spaced arched beams 10, the ends 12 of which are supported on an appropriate base 14.

Door system 2 essentially comprises a stationary arched anchor beam 16 which is of the same size and shape as arched beams 10 of structure 4 and is appropriately secured beside and parallel to an end arched beam 10 of structure 4 as illustrated, together with a plurality of movable arches 18 again of similar size and shape to stationary arch 16. The lower ends of movable arches 18 are secured to pivot about a common axis "A" in a manner which will be described in more detail hereinafter, the lower ends of these movable arches being secured between pairs of plates 20 on either side, at the ends of anchor beam 16. Fabric panels 22 are secured to and extend between anchor beam 16 and its adjacent movable beam 18, and between the remaining adjacent movable beams 18, and a mechanical system generally shown as reference numeral 24 in FIGS. 1 and 2 is provided by which the movable arched beams are moved to open or closed positions and maintained as required in open or closed position or positions intermediate thereto.

Figure 4:
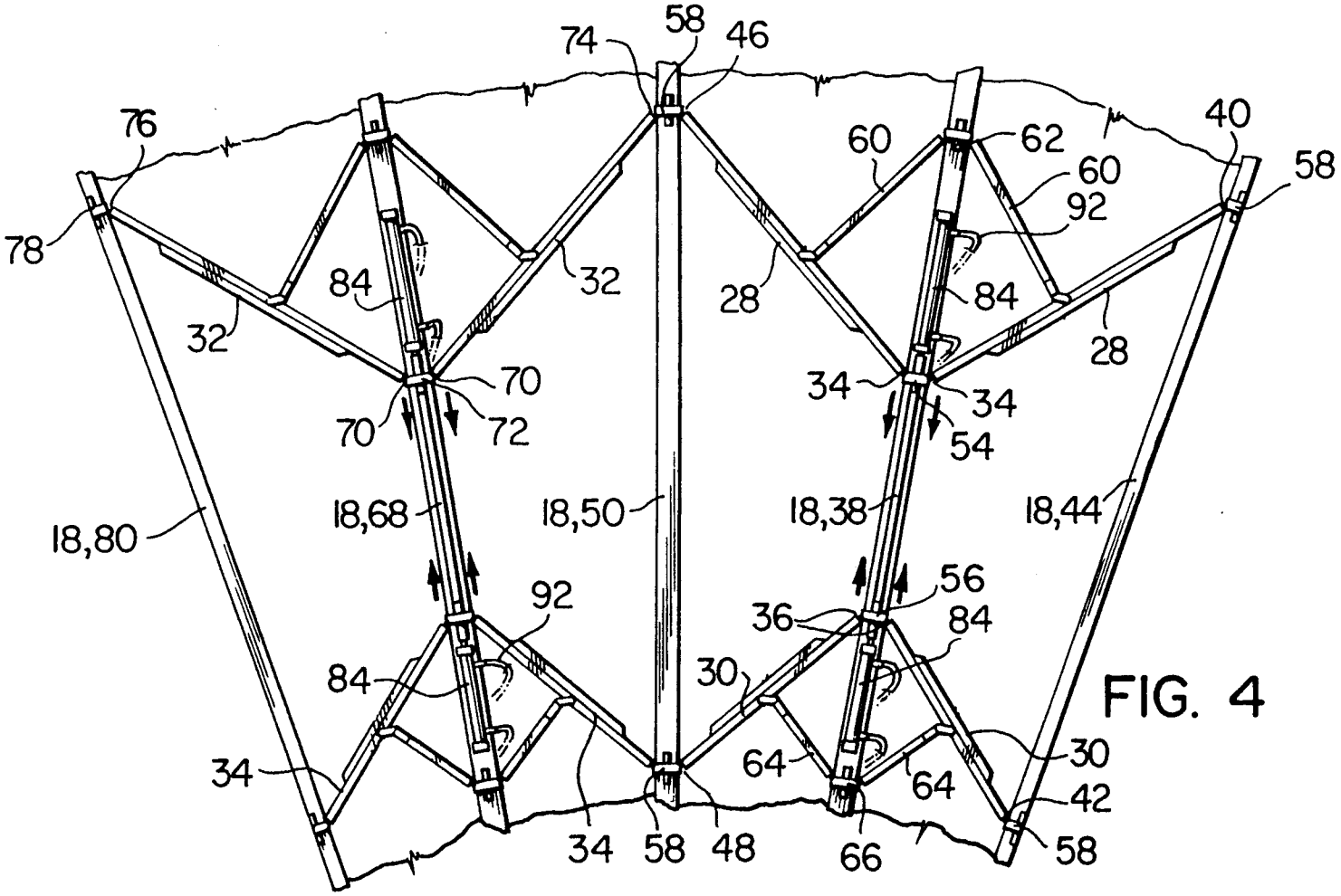
FIG. 4 is a fragmentary plan view of a portion of the door of FIGS. 1, 2 and 3 in closed position detailing cooperating pairs of linking beams on five of the movable arched beams of the door system.

Mechanical system 24 is illustrated in more detail in the fragmentary plan view of FIG. 4, and comprises a plurality of pairs of linking beams 28, 30, 32 and 34 arranged as illustrated. Cooperating pairs 28 and 30 have respectively ends 34 and 36 pivotally secured to one of arched beams 18, namely arched beam 38. Opposite ends 40 and 42, respectively, of right side linking beams 28 and 30 are pivotally secured to arched beam 44 adjacent arched beam 38 on one side. Respective opposite ends 46 and 48 of the other linking beams 28 and 30 are pivotally secured to arched beam 50 on the other side of arched beam 38. Ends 34 and 36 are pivotally secured by means of sliding pivot connectors 54 and 56 respectively, these connectors arranged to slide longitudinally by means of a guide sleeve 57 (FIG. 7) or other appropriate guide means on arched beam 38. The other ends 40, 42, 46 and 48 are pivotally secured to respective arched beams 44 and 50 at fixed pivot connectors 58, these pivot connectors being fixed to and not free to slide on their respective arched beams 44 and 50.

In this manner, considering cooperating pairs of linking beams 28, those beams open and shut, in a scissors-like fashion, with ends 40 and 46 spreading apart and coming together, as arched beams 38, 50 and 44 move between the closed-door position illustrated in FIG. 3, and the open door position illustrated in FIG. 1. Of course, as beams 50, 38 and 44 move from their spread-apart position illustrated in FIG. 4 and open ends 40 and 46 move closer together as they pivot with respect to fixed pivots 58, sliding connector pivot 54 moves progressively in the direction of the arrow along beam 38. As these ends of cooperating linking beams 28 then open (as door system 2 moves to closed position, illustrated in FIG. 3) sliding connector pivot 54 moves in the opposite direction along beam 38.

A similar action of cooperating pairs of linking beams 30 is provided, with the ends 42 and 48 spreading apart and closing in scissors-like fashion as door 2 is respectively closed and opened. In this case however, sliding connector pivot 56 moves simultaneously in a direction opposite to that of sliding connector pivot 54 as the door system is opened and closed.

To facilitate the scissors-like operation of cooperating beams 28 are a pair of braces 60, each of these braces being pivotally secured, at one end, to opposite sides of a fixed pivot connector 62 secured in fixed position to arched beam 38 as illustrated, and the other ends of which are pivotally secured to central portions of linking beams 28 on either side of beam 38, as illustrated. Similarly, braces 64 are pivotally secured at their one ends to a fixed connector pivot 66 and their ends to cooperating linking beams 30 as illustrated.

As can be seen in FIGS. 2, 3 and 4, similar cooperating pairs of cooperating linking beams 32 and 34 operating in scissors-like fashion are provided, extending outwardly and operating in scissors-like fashion, on arched beam 68. For example, the ends 70 of linking beams 32 are pivotally secured to sliding pivot 72 on arched beam 68 and the other ends 74 and 76 are pivotally secured respectively to fixed pivot connector 58 on arched beam 50 and fixed pivot connector 78 on arched beam 80. In this manner, the construction and operation of cooperating linking beams 32 duplicates that of linking beams 28, albeit on arched beams 50, 68 and 80 instead of arched beams 44, 38 and 50. Similarly, the construction and operation of cooperating linking beams 34 correspond to those of linking beams 30, but on arched beams 50, 68 and 80.

A similar arrangement of cooperating linking beams to that of beams 28, 30, 32 and 34 is repeated on the other side system, as can be seen partially in FIG. 3.

Figure 7:
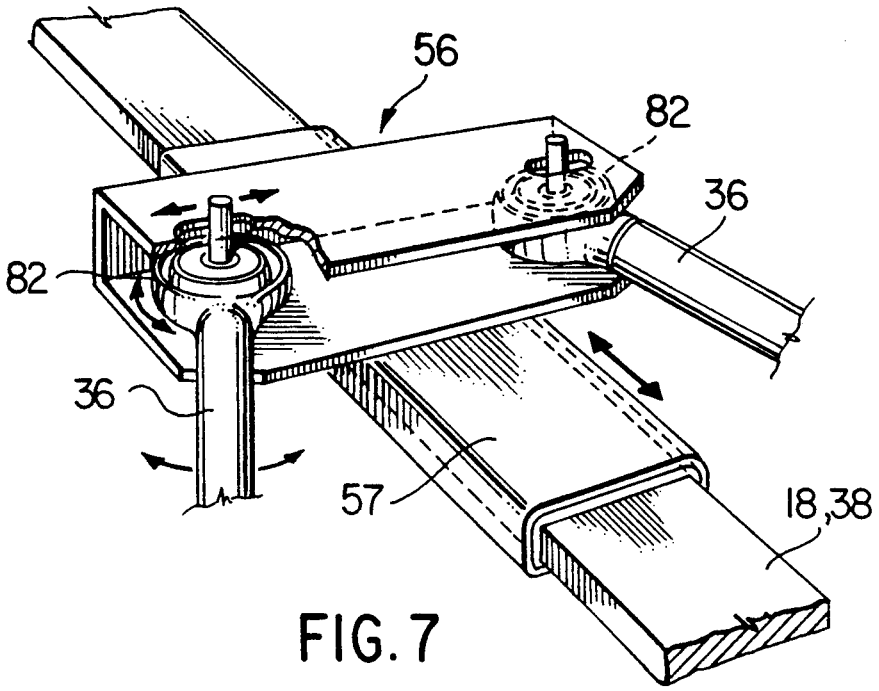
FIG. 7 is an enlarged fragmentary view of a sliding pivot point to which predetermined ends of the linking beams are secured.

FIG. 7 is an enlarged fragmentary view of a sliding pivot connector, such as pivot connector 56, on its associated arched beam 38, illustrating in more detail the manner in which ends 36 of linking beams 30 are pivotally secured thereto, and the manner in which it is guided by guide sleeve 57 for sliding movement along arched beam 38. This construction is typical for the other sliding pivots and associated linking beams. In particular ends 36 of beams 30 (as well as opposite ends 42 and 48 respectively) are secured to the corresponding sliding or fixed pivots by means of ball joint rod ends 82. This is necessary because, as movable arched beams 18 move relative to one another, the ends of the linking beams secured thereto tend to rotate around the axis of the arched beam as the included angle formed between each linking beam and its corresponding arch changes.

To effect this opening and closing of door system 2, any mechanical means to apply the appropriate directional forces to sliding pivots 34 and 36 may be provided, such as a worm gear arrangement or, in the illustrated embodiment (FIGS. 4 and 5), an arrangement of hydraulic cylinders 84. Because the movable arched beams 18 are connected to one another by the above-mentioned series of cooperating linking beams which beams are moved by hydraulic cylinders 84, this causes the arched beams 18 to move closer together or farther apart, resulting in door system 2 opening or closing.

Figure 8:
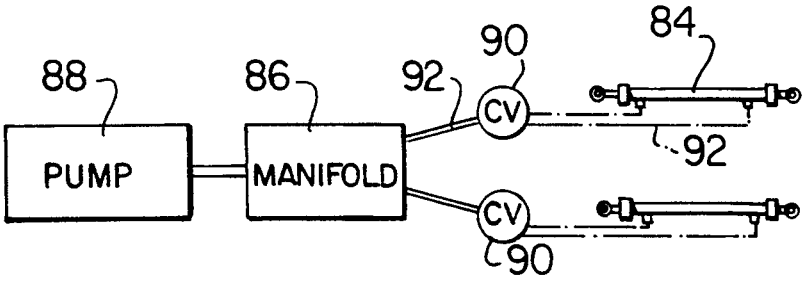
FIG. 8 is a fragmentary schematic view illustrating an hydraulic drive arrangement for the door system of the present invention.

FIG. 8 is a fragmentary schematic view illustrating in more detail the hydraulic system which causes this motion. Hydraulic cylinders 84 are tied together by manifold 86 so that they all receive equal pressure from hydraulic pump 88 and therefore exert equal forces, through their corresponding sliding pivots (34, 36, etc.), resulting in equal lift on the corresponding arch beam 18. A counterbalance valve 90 is installed at the base of each cylinder 84 to provide two functions. Firstly, valve 90 prevents oil from flowing uncontrolled out of its corresponding cylinder 84 in the event of the rupture of an hydraulic line 92. This prevents an open or partially open door 2 from falling closed because of a failure of the hydraulic system. In other words, door 2 must in fact be "power closed". Secondly, these counterbalance valves 90 prevent uncontrolled flow of hydraulic fluid between cylinders 84, eliminating the possibility of one cylinder extending while another is retracting due to fluid transferring between cylinders through manifold 86. These counterbalance valves 90 do not inhibit the flow of hydraulic oil from the pump to the cylinder which has the least load.

The hydraulic oil is pumped from pump 88 to the cylinder 84 which will move most easily, thus allowing it to travel first and causing it to pick-up its share of the load. This feature is necessary because the cylinders 84 closest to the upper ridge 94 (FIG. 3) of arched beams 38 or 68 must travel farther and thus faster than those nearest the "eaves" of those arched beams.

Figure 5:
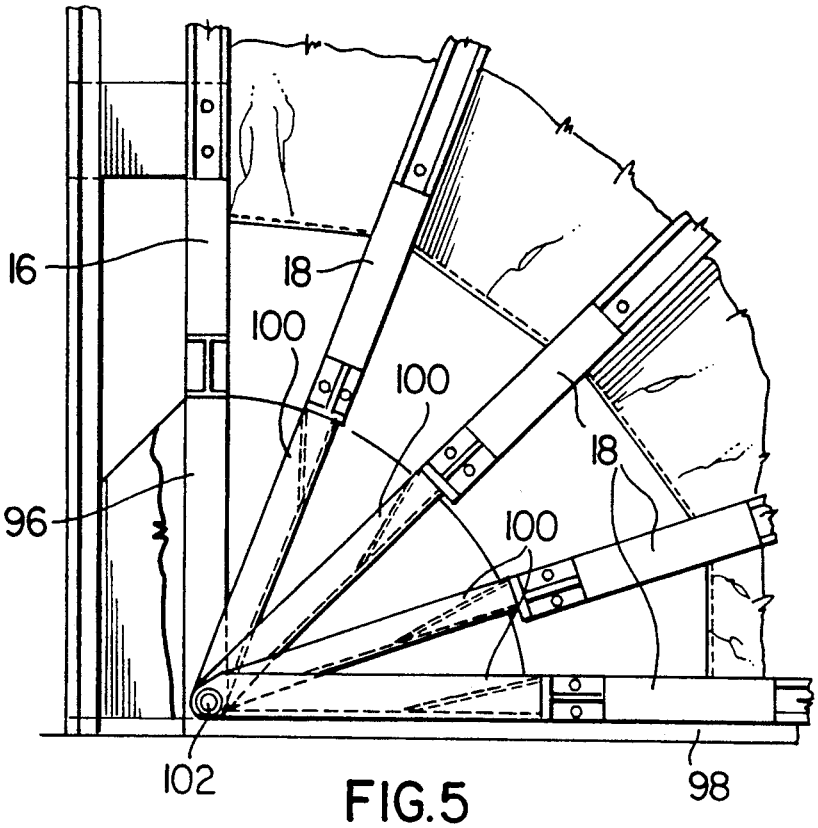
FIGS. 5 and 6 are fragmentary, side elevation views of the hinge arrangement for the ends of the movable arched beams of the door system of FIGS. 1 and 2, with the door respectfully in closed and open positions.
Figure 6:
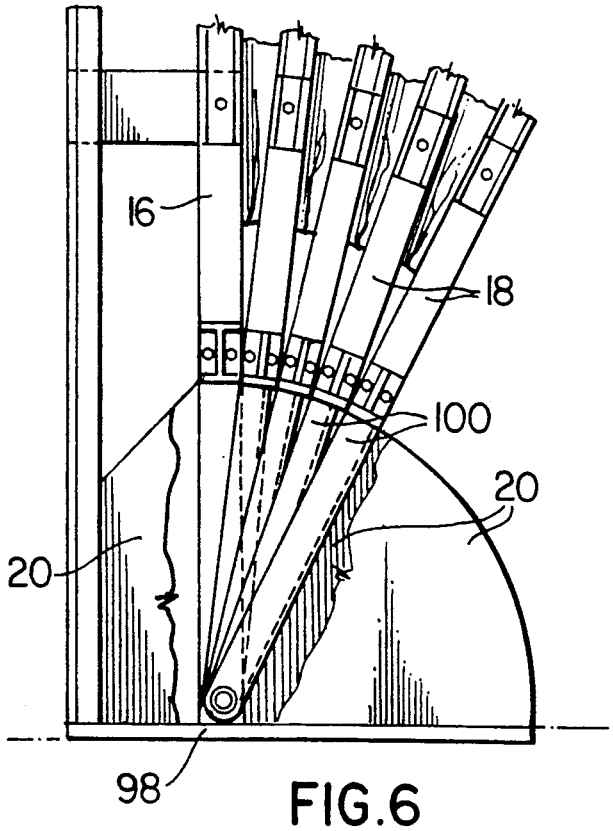

Turning to FIGS. 5 and 6, for proper operation of door 2 in accordance with the present invention, all of the movable arched beams 18 of the door align to a common pair of pivot points located along the axis "A" (FIG. 2) at opposite ends of arched beams 18. In this manner, all arched beams 18 will follow the same radial path. The result of having the common pivot points and arched beams of the same height "radius" is that there is no offset in the open position of door 2 and they form equal segments in the closed position (FIG. 3). The top arch of the door, "header arch" 16 is stationary. It is spliced to a stationary nesting channel 96 which is attached to a base plate 98 and a pair of quadrant-shaped side plates 20. It will be noted that each of moving beams 18 progressively further removed from header arch 16 is secured to a progressively smaller channel arm 100, which nests within the next, correspondingly larger arm 100, when the door is in open position, as illustrated in FIG. 1. Each of these arms 100 is pivotally secured by pivot 102 to pivot about the same axis "A" (FIG. 2). In other words, the common hinge pivot 102 is accomplished by using this series of nesting channel arms 100 which are spliced to the arched beams 18.

In summary, the linking beams (28, 30, etc.) are attached to each arched beam at four points. The locations of these points were chosen so that the reactions at all four "lifting points" would be equal. In operation, as the sliding pivot pivots (34, 36, etc.) travel along their corresponding guides 57 on the corresponding arched beam 38 (etcetera), the linking beams (28, 30, etc.) on each side of the arched beam (38, etc.) tend to draw the adjacent arches (44, 50, etc.) closer or push them farther away from that central arch 38. There are four sliding pivots complete with corresponding hydraulic cylinders 84 on alternate arched beams. These four sliders correspond to the four "lifting points" on each arched beam, but guide one end of each of the linking beams and transfer the forces from the hydraulic cylinders 84 into the linking beams.

The linking beams are arranged in a "scissors-like" configuration but are not a true scissors. The adjacent arched beams, when viewed in true plan when the door is closed, are in fact inclined to one another, but as the door opens the arched beams move closer together and also tend to become parallel to one another.

Thus it is apparent that there has been provided in accordance with the invention a clam shell door system for stressed fabric structure that fully satisfies the objects, aims and advantages set forth above. While the invention has been described in conjunction with a specific embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. In a stressed fabric structure of the type having walls and a roof formed of fabric secured to and extending under tension between spaced arched beams having ends supported on a base, a door system comprising a stationary arched anchor beam having ends supported on the base at one end of the structure;

a plurality of movable arched beams on one side of said anchor beam away from the structure and having supporting ends pivotally secured at the ends of the anchor beam, said movable beams being pivotal along a common radial path about a common pivot axis at the ends, between a raised, open position adjacent to said anchor beam and a closed position in which said movable beams are spaced progressively from said anchor beam to the structure base;

fabric panels secured to and extending between each of said anchor beam and its adjacent movable beam and adjacent pairs of movable beams so as to be under similar tension when said beams are in said closed position; and mechanical means simultaneously to move said movable beams to said open or closed positions and to maintain said movable beams in said open or closed position or positions intermediate thereto.

2. A door system according to claim 1 wherein said means to move the beams comprises a plurality of linking beams having ends pivotally secured at pivot points to and extended between all adjacent beams of the door system, cooperating pairs of adjacent linking beams extending from similar locations on alternative movable beams, in spreading, scissors-like fashion, to beams adjacent thereto on each side, to move their corresponding beams between open and closed positions; and drive means associated with the linking beams to move them between said open and closed positions and maintain them as required in said open or closed positions or positions intermediate thereto.

3. A door system according to claim 2 wherein corresponding ends of linking beams in each pair are secured at spaced locations to each of said alternate movable beams, and opposite spreading ends of the linking beams in each pair are secured to beams adjacent thereto on each side.

4. A door system according to claim 3 wherein the pivot points, at which the ends of cooperating pairs of linking beams are secured to the alternate movable beams, are slidable along a longitudinal axis of the corresponding arched beam.

5. A door system according to claim 4 wherein the pivot points at which the ends of the pairs of linking beams are secured to beams adjacent said alternative movable beams are fixed to the corresponding beams and not relatively movable with respect thereto.

6. A door system according to claim 5 wherein said drive means comprises hydraulic cylinder means associated with said cooperating pairs of linking beams to cause them to spread and close in scissors-like fashion.

7. A door system according to claim 6 wherein said hydraulic cylinder means are arranged to act on the slidable pivot points.

8. A door system according to claim 7 wherein pairs of cooperating pairs of linking beams are arranged to spread in opposite directions on each of said alternate beams and said cylinder means are arranged to move the corresponding slidable pivot points simultaneously in opposite directions.

9. A door system according to claim 8 wherein the hydraulic cylinder means comprises hydraulic cylinders hydraulically associated with a manifold means which ensures that the hydraulic cylinders receive equal hydraulic pressure and hence exert equal forces on the linking beams.

10. A door system according to claim 9 wherein the hydraulic cylinder means further comprises a counterbalance valve means hydraulically associated with the manifold means and the hydraulic cylinders to prevent closing of the door system in the event of uncontrolled escape of hydraulic fluid from the cylinder means, and to prevent uncontrolled flow of hydraulic fluid between the hydraulic cylinders.

11. A door system according to claim 2 wherein said drive means comprises hydraulic cylinder means associated with said cooperating pairs of linking beams to cause them to spread and close in scissors-like fashion.

12. A door system according to claim 2 wherein the ends of the linking beams are secured to said arched beams by means of ball joints to provide universal movement of these ends with respect to the corresponding arched beams during corresponding travel of those arched beams during opening and closing of the door system.

13. A door system according to claim 2 wherein said fabric panels are of similar size and shape and the linking beams are attached to the movable arched beams so that the forces on all linking beam pivots are approximately equal.

14. A door system according to claim 1 wherein corresponding ends of movable arched beams are secured to corresponding arms, said arms being nestable with respect to each other and pivotable about the same axis during opening and closing of the door system.

15. A door system according to claim 1 wherein the stationary anchor arched beam is secured to an end arched beam of the fabric structure.

16. A door system for a stressed fabric structure comprising a stationary arched anchor beam having a pair of ends for securement to a base;

a plurality of movable arched beams, each movable beam having a pair of ends pivotally mounted adjacent respective ends of said anchor beam for movement of said respective movable beam between an open position adjacent said stationary anchor beam and a closed position;

a plurality of fabric panels, each panel being secured between a respective pair of movable arched beams; and a plurality of hydraulically actuated means, each said means being secured to between each respective pair of movable arched beams for moving said respective pair of movable arched beams between said open and closed positions thereof and to maintain said panels in a tensioned condition in said closed position; and manifold means connected to at least a pair of said hydraulic means to maintain equal hydraulic pressure thereon.

17. A door system as set forth in claim 16 wherein said means includes at least one linking beam pivotally secured to and between each beam of a respective pair of movable arches and a hydraulic cylinder means mounted on one of said arches of said respective pair of movable arches and secured to one end of said linking beam for moving said end along said one arch to effect opening and closing of said pair of movable arches relative to each other.

18. A door system as set forth in claim 17 which further comprises a ball joint connecting at least one end of said linking beam to a respective beam of a respective pair of movable arches.

19. A door system as set forth in claim 16 wherein said movable beams are pivotally mounted on a common axis.

* * * * *